US005437261A

United States Patent [19]

Paulson et al.

[11] Patent Number: 5,437,261

[45] Date of Patent: Aug. 1, 1995

[54] BALL PITCHING DEVICE

[75] Inventors: Kerry K. Paulson, Sherwood; Charles E. Kerr, Hillsboro; Paul A. Heinsch, Portland, all of Oreg.

[73] Assignee: Jugs, Inc., Tualatin, Oreg.

[21] Appl. No.: 144,109

[22] Filed: Oct. 27, 1993

[51] Int. Cl.[6] ..... A63B 69/40

[52] U.S. Cl. ..... 124/78; 124/1; 124/81; 273/26 D

[58] Field of Search ..... 124/78, 80, 81, 1, 6, 124/83; 273/26 D, 294

[56] References Cited

U.S. PATENT DOCUMENTS

| | | | |
|---|---|---|---|
| 3,724,437 | 4/1973 | Halstead | 124/78 |
| 3,774,584 | 11/1973 | Paulson | 124/1 |
| 3,777,732 | 12/1973 | Holloway et al. | 124/78 |
| 3,913,552 | 10/1975 | Yarur et al. | 124/78 |
| 4,193,591 | 3/1980 | Paulson | 272/78 |
| 4,197,827 | 4/1980 | Smith | 124/78 |
| 4,423,717 | 1/1984 | Kahelin | 124/78 |
| 4,561,414 | 12/1985 | Nozato | 124/78 |
| 4,632,088 | 12/1986 | Bruce | 124/78 |
| 4,760,835 | 8/1988 | Paulson et al. | 124/78 |
| 4,823,763 | 4/1989 | Ponza | 124/78 |
| 5,046,476 | 9/1991 | Nozato | 124/78 |
| 5,125,653 | 6/1992 | Kovács et al. | 124/78 X |
| 5,359,986 | 11/1994 | Magrath, III et al. | 124/78 |

*Primary Examiner*—Randolph A. Reese
*Assistant Examiner*—Harry C. Kim
*Attorney, Agent, or Firm*—Olson & Olson

[57] ABSTRACT

A ball pitching device includes a ball feed tube mounted on support components which are adjustable about vertical and horizontal pivot axes to vary the horizontal and vertical positions of delivery of pitched balls relative to a practicing batter standing at the position of home plate. The device also includes a pair of ball projecting wheels rotated by electric motors the speeds of which are adjusted by controlling potentiometers. Eccentric cams are included in the support components for enabling incremental adjustments about the vertical and horizontal pivot axes, preferably without recognition by the practicing batter, to make incremental changes in the horizontal and vertical positions of delivery of pitched balls. The electric circuit of the drive motors also includes adjustable electric signal generators operatively connected to the support components providing for elevation adjustments, for effecting changes in motor speed in accordance with changes in elevation of the ball feed tube.

16 Claims, 8 Drawing Sheets

BALL PITCHING DEVICE

BACKGROUND OF THE INVENTION

This invention relates to ball throwing devices, and more particularly to such a device which is adjustable to pitch balls at various speeds, spins and directions.

U.S. Pat. Nos. 3,774,584; 4,193,591; and 4,760,835 have common ownership with the instant application and they disclose ball throwing devices in which a pair of rotary wheels are independently adjustable in speed to achieve the throwing of a ball with wide variations in velocity and curvature. However, neither the foregoing patents nor any other known patent provides for adjusting the speed and/or direction of such wheels in small increments by means which are difficult to detect by a batter from the distance of the pitching mound. Thus, a practicing batter is given advance information as to the type and speed of pitch to be delivered, and thereby receives no training in instantaneous recognition of various pitches in the manner delivered by a pitcher in actual play.

SUMMARY OF THE INVENTION

The ball pitching device of this invention includes pivot means for adjusting the elevation to which a ball delivery axis of rotating wheels are pointed, and lever means associated with the pivot means for effecting incremental adjustments of said elevation, and electrical means associated with the lever means for adjusting the speed of rotation of the rotating wheels incrementally in accordance with the incremental adjustment in elevation.

It is the principal objective of this invention to provide a ball pitching device with incremental adjustments of speed and direction of a pitched ball.

Another objective of this invention is the provision of a ball pitching device of the class described in which the incremental adjustments are accomplished by means which are difficult to detect by a batter located a distance from the device equal to the distance between a batter's box and a pitching mound.

A further objective of this invention is to provide a ball pitching device of the class described in which the incremental adjustment of speed may be a single step between a given speed and a higher or lower speed, or an infinite variation between one speed and another.

A still further objective of this invention is the provision of a ball pitching device of the class described which is of simplified construction for economical manufacture, maintenance and repair.

The foregoing and other objects and advantages of this invention will appear from the following detailed description, taken in connection with the accompanying drawings of preferred embodiments.

DESCRIPTION OF THE PREFERRED EMBODIMENTS

Figure 1:
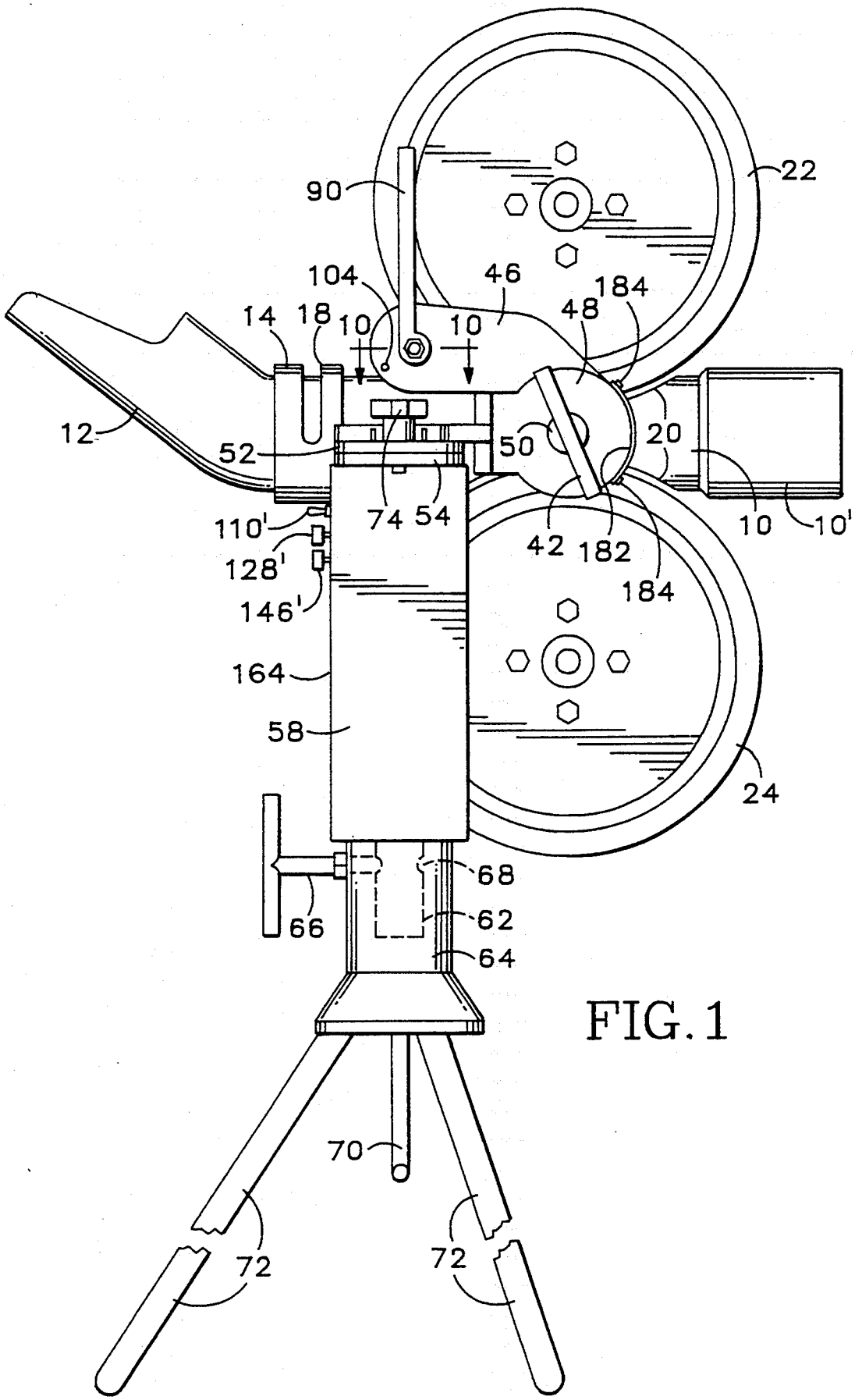
FIG. 1 is a foreshortened side elevation of a ball pitching device embodying the features of this invention.

The drawings illustrated a general form of ball pitching device which includes a ball feed tube 10 having a ball feed chute 12 at one end mounted for limited axial rotation in a collar 14 on the feed tube, and a cylindrical outfeed extension 10' at the opposite end. The rotation of the feed chute is limited by movement of a clamp screw 16 on the chute in an arcuate slot 18 in the collar. The clamp screw is manipulated by a hand knob 16' which releasably engages the collar to clamp the chute in selected position of rotation.

Figure 2:
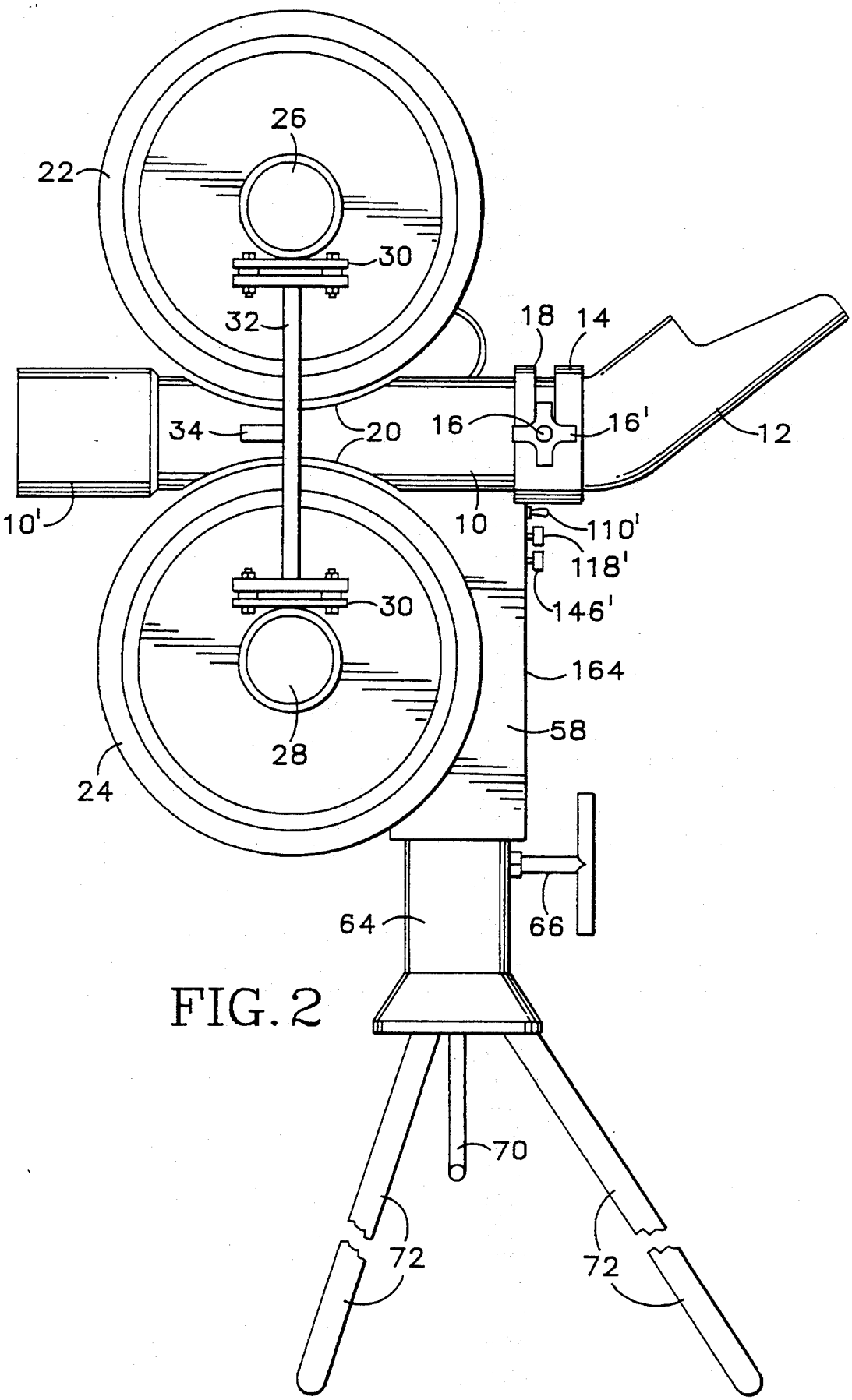
FIG. 2 is a foreshortened side elevation of the ball pitching device of FIG. 1 as viewed from the side opposite FIG. 1.
Figure 3:
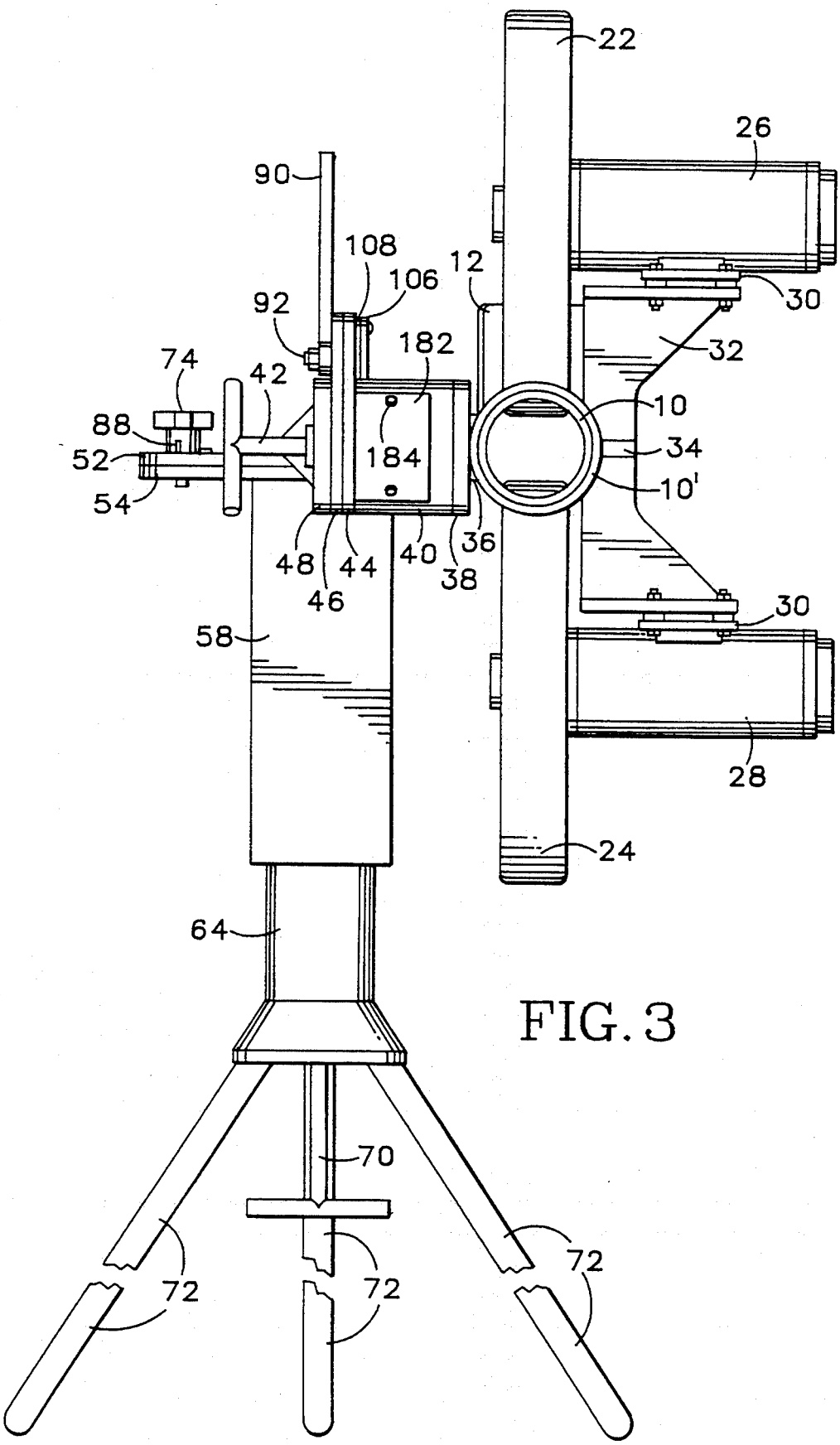
FIG. 3 is a foreshortened front elevation as viewed from the right in FIG. 1.

The opposite intermediate sides of the feed tube are cut away to provide arcuate slots 20 for the reception of ball propelling rotary wheels 22 and 24. The wheels are mounted on the rotary output shafts of direct current electric motors 26 and 28, respectively. The motors are mounted on support bases 30 (FIGS. 2 and 3) at the opposite ends of a base frame 32 secured to the feed tube 10, as by a welded flange 34.

Figure 4:
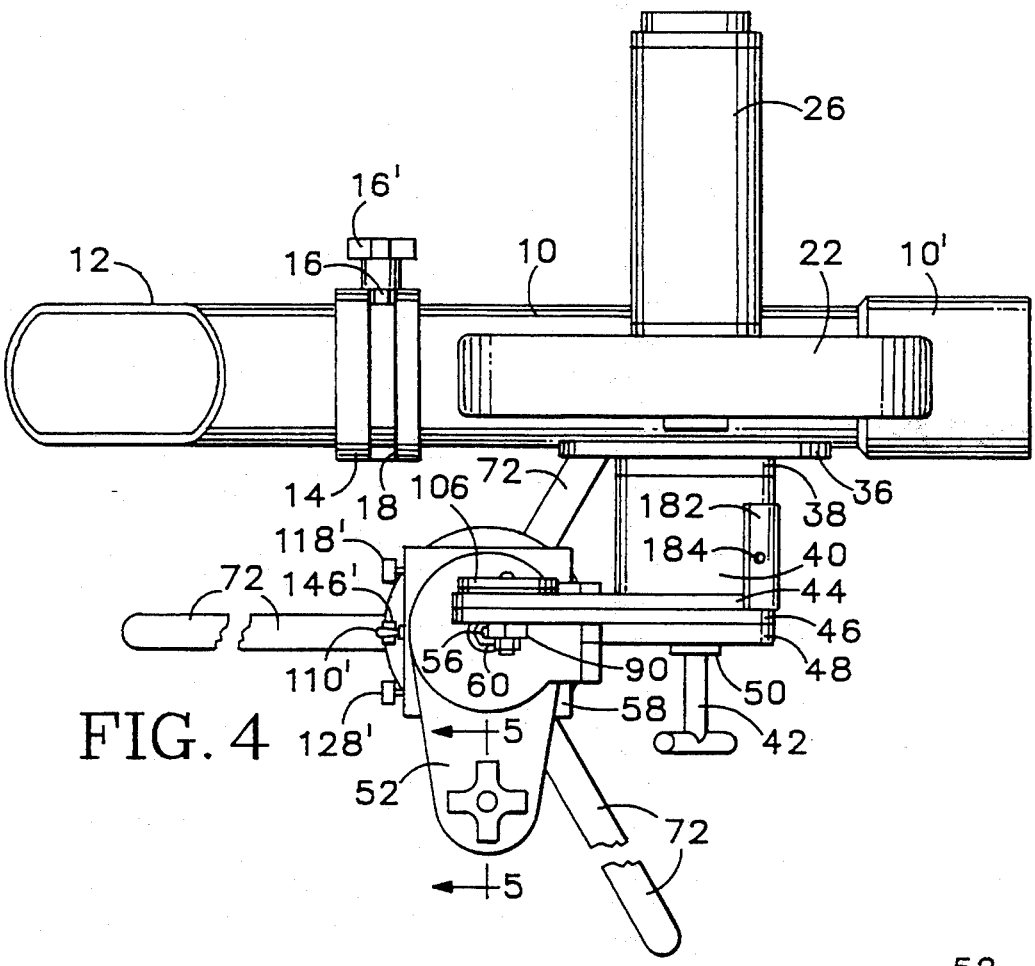
FIG. 4 is a foreshortened plan view as viewed from the top in FIG. 1.
Figure 9:
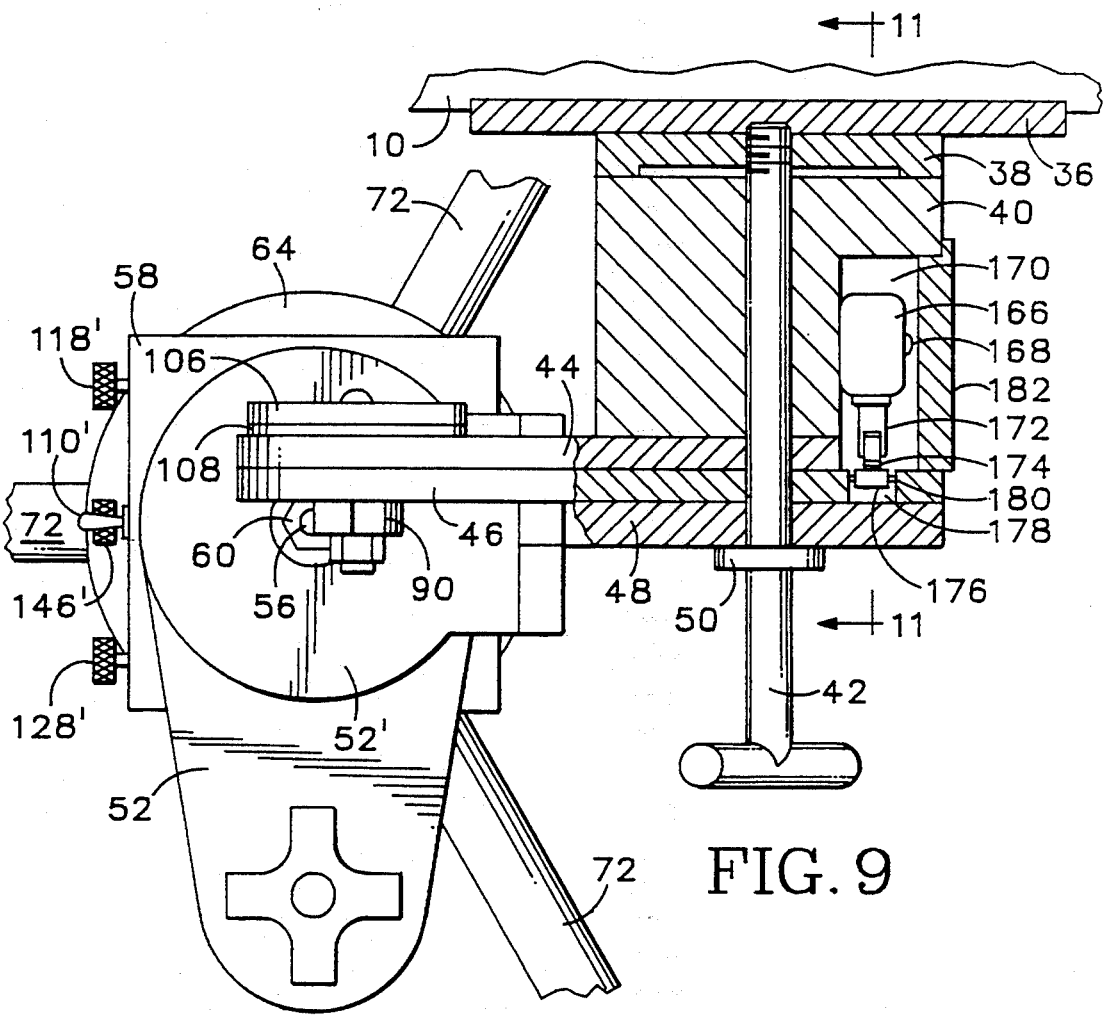
FIG. 9 is a fragmentary plan view, similar to FIG. 7 and partly in section, showing the vertical incremental adjustment mechanism and the cooperating electrical speed adjustment mechanism.
Figure 10:
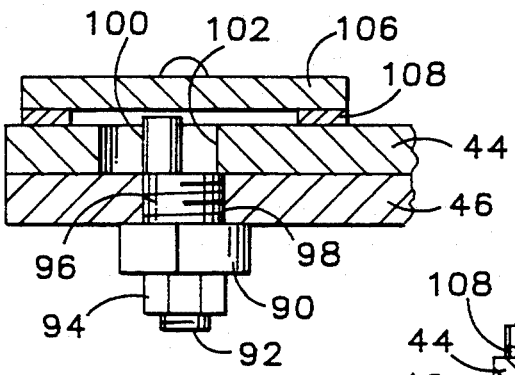
FIG. 10 is a fragmentary sectional view taken on the line 10—10 in FIG. 1.

The feed tube 10 also supports a plate 36 (FIGS. 4 and 9) to which is welded or otherwise secured an end disc 38 of an elevation adjustment cylinder 40. The cylinder is supported by a clamp screw 42 which extends from a threaded opening in the end disc 38, through the central bore of the cylinder. The clamp screw also extends through aligned openings in pivot plate 44, fixed anchor plate 46 and reinforcing cap plate 48 secured to anchor plate 46. A clamp collar 50 on the screw 42 is arranged to abut the outer side of cap plate 48 and draw the assembly of plates and cylinder together when the clamp screw is tightened.

Figure 5:
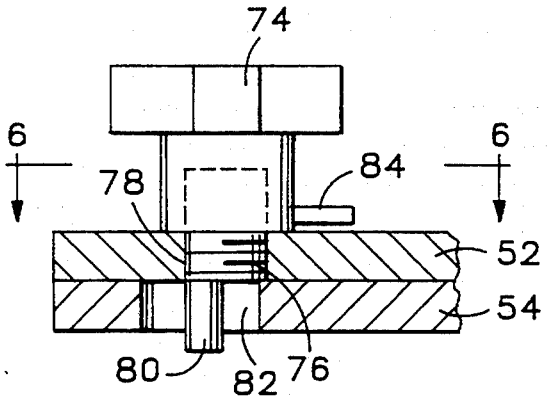
FIG. 5 is a fragmentary sectional view taken on the line 5—5 in FIG. 4.
Figure 6:
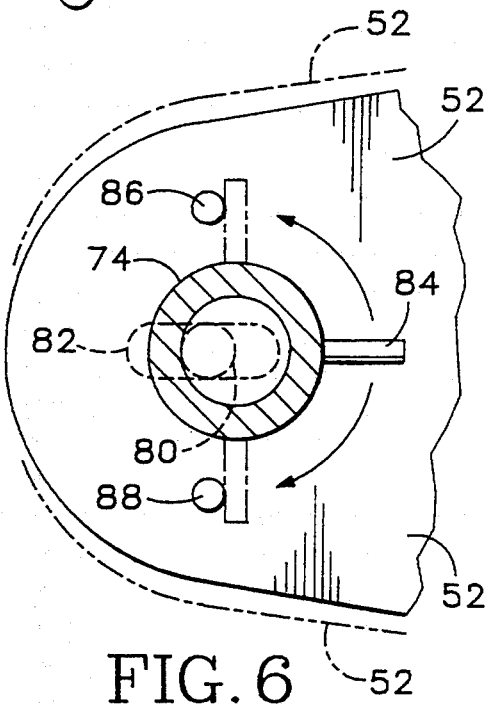
FIG. 6 is a fragmentary sectional view taken on the line 6—6 in FIG. 5.
Figure 7:
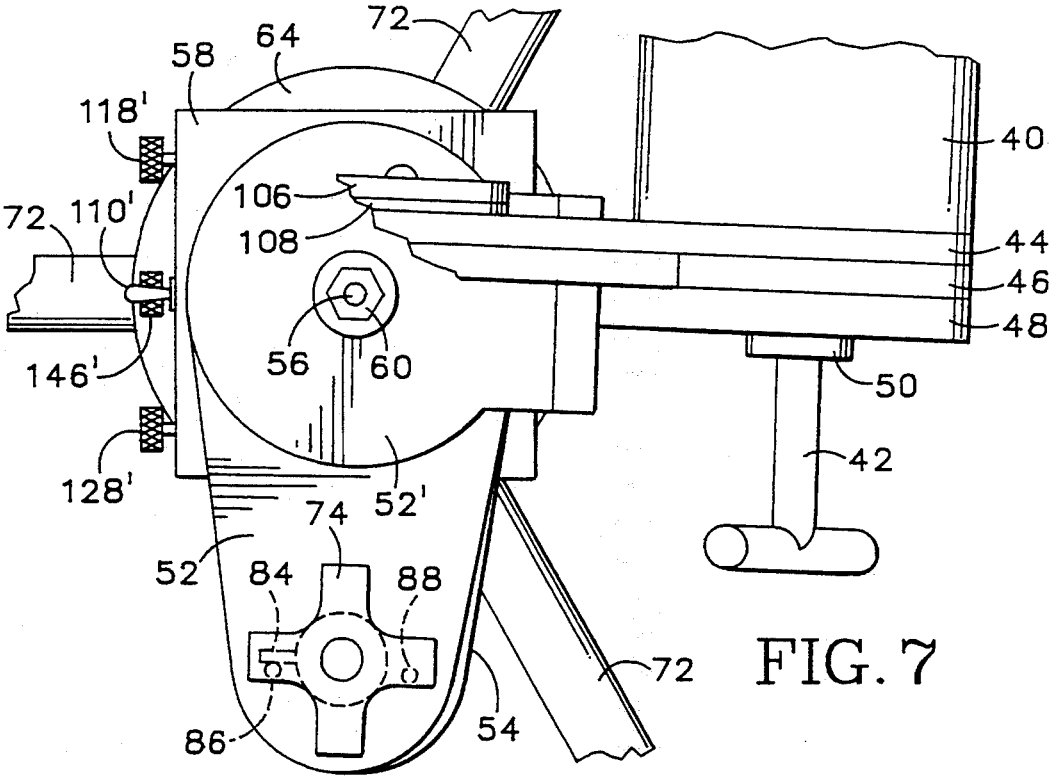
FIGS. 7 and 8 are fragmentary plan views, on an enlarged scale, of the horizontal incremental adjustment mechanism showing adjustments to opposite maximum side positions.
Figure 8:
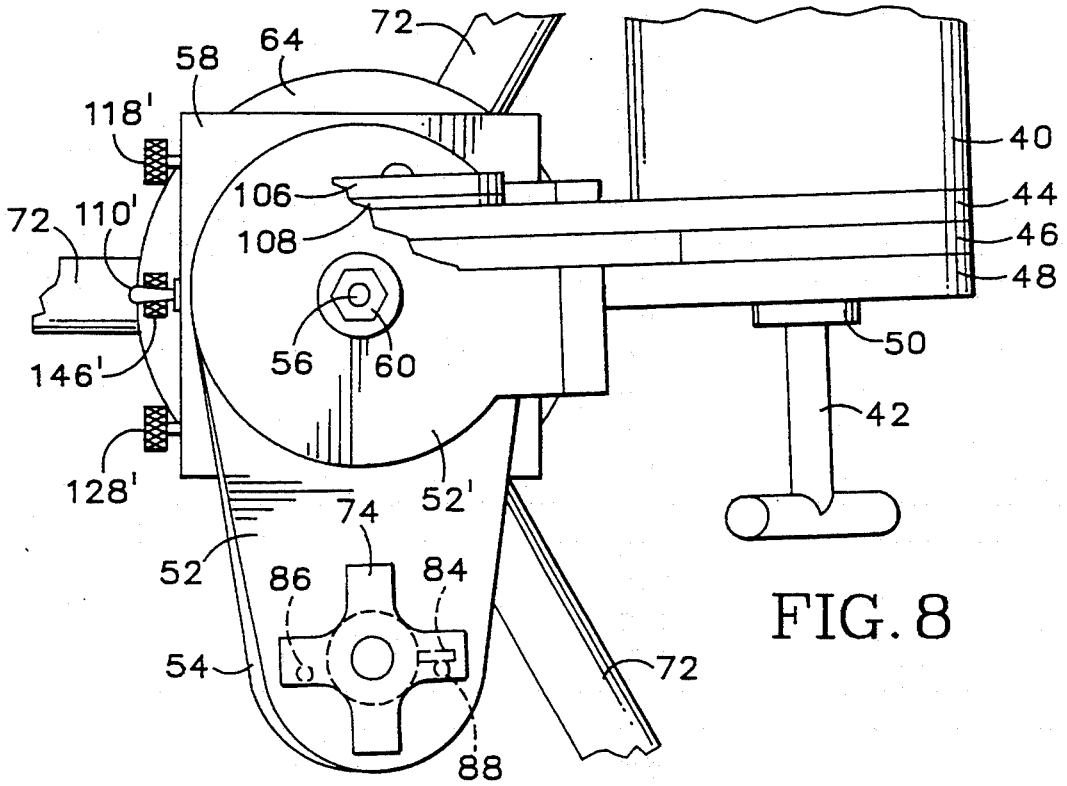

The cap plate 48 and the end of anchor plate 46 opposite the cylinder 40 are secured to a reinforcing cap plate 52' of a horizontally disposed pivot plate 52. Slidably abutting the underside of pivot plate 52 is horizontal anchor plate 54 (FIG. 5). The pivot plate is supported on the anchor plate for pivotal movement about the axis of pivot bolt 56 which is welded or otherwise secured to the anchor plate and extends through aligned openings in the plates 52 and 54. The anchor plate is welded or otherwise secured to the top plate of a vertically extending base member 58 formed of bottom, top, side and removable front plates secured together to form a hollow structure. A nut 60 with washer is threaded onto the threaded end of bolt 56 for adjustably clamping the plates 52 and 54 together.

The base member 58 is provided with a pivot post 62 extending downwardly from the bottom plate of the base member. The post is received rotatably in a socket formed in body member 64. A set screw 66 extends through the body member toward the socket, and is arranged for releasable engagement in any one of a plurality of detents 68 in the base member pivot post 62.

The bottom end of the body member 64 is provided with clamping mechanism, including clamp screw 70, configured to detachably secure the three legs 72 which form a tripod support for the ball pitching device.

The foregoing assembly of components functions to pitch baseballs and/or softballs to provide batting practice for a player. For this purpose, adjustment of relative speeds of rotation of the two wheels 22 and 24 effects change in the type of pitch delivered. Adjustment of elevation, to change the trajectory of a pitch, is achieved by loosening the clamp screw 42 and rotating the feed tube 10 and associated wheel assembly about the horizontal axis of the elevation adjustment cylinder 40. Horizontal adjustment, to change the delivery of a pitch between inside and outside positions relative to a batter, is achieved by loosening the nut 60 of pivot bolt 56 and rotating the feed tube 10 and associated wheel and supporting plate assembly about the vertical axis of the pivot bolt 56.

Balls are pitched to a batter by feeding them, one at a time, through the infeed chute 12 to the feed tube 10 where they are engaged by the rotating wheels 22 and 24 projecting into the side slots 20, and projected through the outfeed extension 10' toward a batter's plate.

In accordance with this invention, means are provided by which the vertical and horizontal adjustments may be made in incremental steps, and preferably without recognition by the batter. The batter thus may be confronted with a variety of pitches delivered at various speeds and at various horizontal and vertical positions, whereby to greatly enhance the batter's ability to adjust to sudden changes of pitches as experienced in actual play.

Incremental horizontal adjustment of pitch delivery is provided, in the embodiment illustrated, by hand manipulation of horizontal adjustment knob 74. This knob is provided with a threaded shaft 76 retained in threaded bore 78 in pivot plate 52, for limited rotation about the vertical axis of the threaded shaft. An eccentric cam pin 80 extends from an off-axis position on threaded shaft 76 and is retained in an elongated slot 82 in the anchor plate 54, for sliding reciprocation along the slot. The range of pivotal movement of the knob 74, and hence the shaft 76 and pin 80, is established by abutment of limit pin 84 on knob 74 with circumferentially spaced stop pins 86 and 88 on the pivot plate 52. This pivotal movement effects incremental horizontal pivotal movement of pivot plate 52 and hence feed tube 10.

Although the range of horizontal adjustment of pitch delivery may be varied as desired, it is preferred to provide pitches that range from slightly inside to slightly outside, relative to a home plate position of a practicing batter.

It is to be noted that manipulation of the horizontal adjustment knob 74 is difficult to detect by a batter located at the distant position of home plate from the pitcher's mound. Accordingly, the batter receives valuable training in learning the skills of concentration and eye coordination necessary for effective batting.

Incremental vertical adjustment of pitch trajectory is provided, in the embodiment illustrated, by elevation adjustment lever 90. The lever is provided with a non-circular opening which receives the non-circular portion of a shaft extension 92. The outer threaded portion of the shaft extension receives a clamp nut 94. The shaft extension projects from a threaded shaft 96 which like knob shaft 76, is retained in a threaded bore 98 in the anchor plate 46 for limited rotation about the horizontal axis of the threaded shaft 96. An eccentric cam pin 100 extends from an off-axis position on the shaft 96 and is retained in an elongated slot 102 in the pivot plate 44, for sliding reciprocation along the slot.

The range of pivotal movement of lever 90 may be selected as desired. As illustrated, the range is established by rotation of the lever between abutment of the lever with the upper edge of cap plate 46' and with stop pin 104.

The slot 102 and eccentric pin 100 are protected from dust and other atmospheric debris by cover plate 106 and peripheral seal 108.

Figure 14:
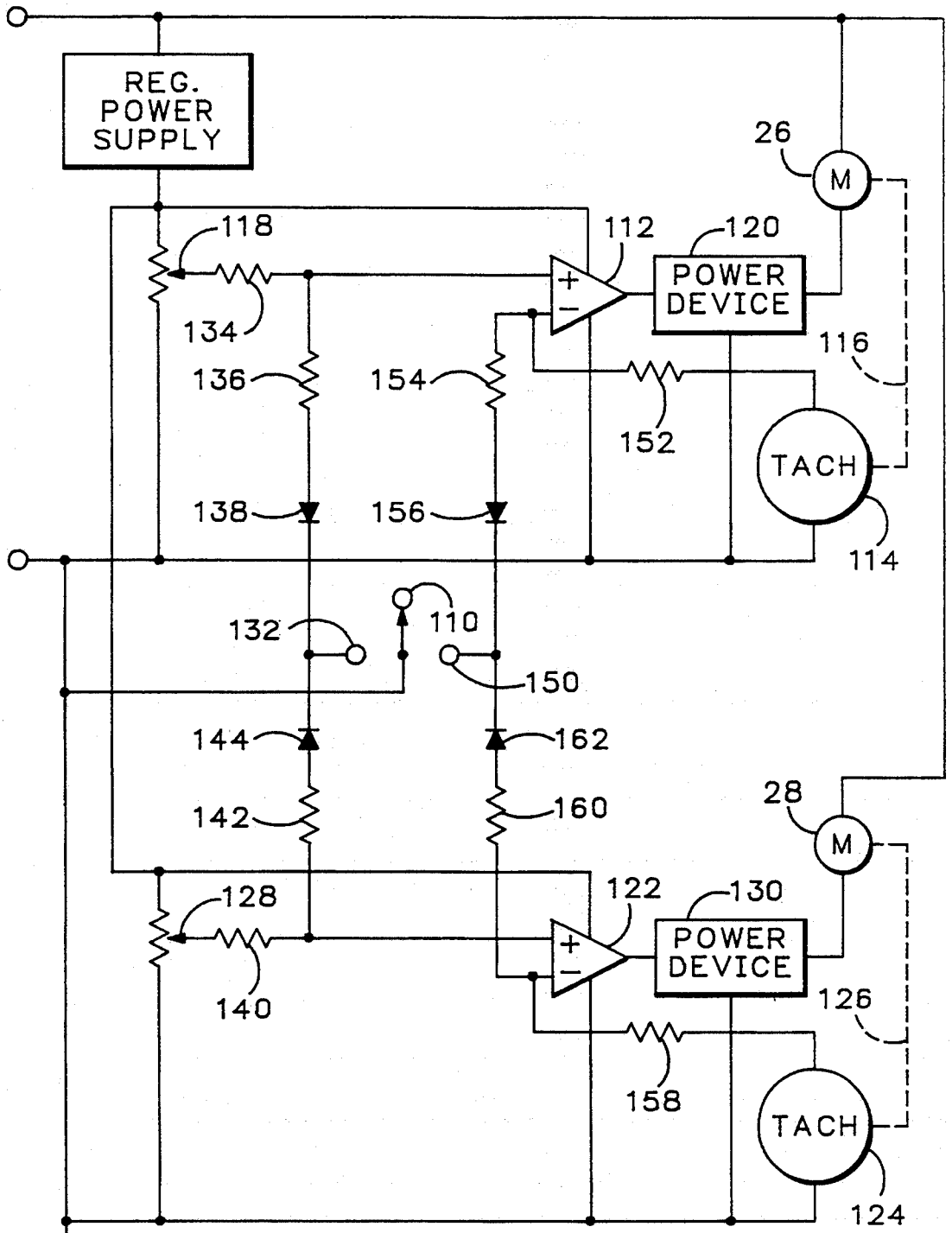
FIGS. 14 and 15 are schematic diagrams of electrical circuits for controlling the speed of the wheel driving motors.
Figure 15:
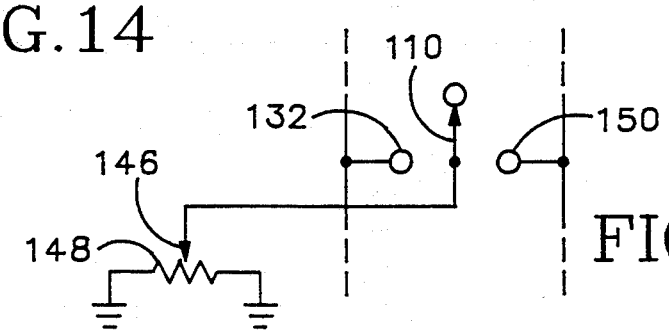

Means also is provided for adjusting the rotational speed of the drive motors and their associated ball pitching wheels, as the elevation trajectory is changed. Thus, for example, if it is desired to change from a fast ball to a change-up pitch, it is necessary to increase the elevation and reduce motor speed. On the other hand, if it is desired to change from a low fast ball to a high faster ball, the elevation must be raised and the motor speed must be increased. FIGS. 14 and 15 illustrate schematically electrical circuits for adjusting the rotational speed of the drive motors and hence of the ball-projecting wheels.

Referring to FIG. 14, the electric circuit is operable selectively to allow elevation adjustments to be made without changing the rotational speed of the wheels, and to allow elevation adjustments while automatically increasing or decreasing the rotational speed of the wheels.

With selector switch 110 in the open position illustrated, the comparator 112 senses whether the feedback voltage from tachometer 114, connected to the output shaft of drive motor 26 by suitable means indicated by the broken line 116, matches the voltage set manually by speed adjustment potentiometer 118. If the feedback voltage is less than the voltage set by the potentiometer 118 the comparator provides an electric signal to power device 120, such as a transistor or silicon controlled rectifier, to effect increase in speed of drive motor 26 until the feedback voltage equals the speed adjustment voltage.

Similarly, comparator 122 senses whether the feedback voltage from tachometer 124, connected to drive motor 28 by means indicated by broken line 126, matches the voltage set manually by speed adjustment potentiometer 128. If the feedback voltage is less, the comparator 122 provides an electric signal to power device 130 to effect increase in speed of drive motor 28 until the feedback voltage equals the speed adjustment voltage.

On the other hand, if the feedback voltage is greater than the voltage set by the potentiometers 118 and 128, the electric signals provided by the comparators 112 and 122 to the power devices 120 and 130 effect decrease in speed of the drive motors 26 and 28 until the feedback voltages equal the speed adjustment voltages.

Let it now be assumed that selector switch 110 is moved to the position closing contact 132. Accordingly, some of the voltage previously provided to comparator 112 by the speed adjustment potentiometer 118 is shunted to ground through resistor 134, shunt resistor 136, diode 138 and switch 110. Less voltage therefore is available to the comparator and power device 120, resulting in decrease in rotational speed of drive motor 26. The same result occurs with drive motor 28 because of the shunting action of speed adjustment potentiometer 128 through resistor 140, shunt resistor 142, diode 144 and switch 110.

Diodes 138 and 144 function to isolate the two control circuits from each other when switch 110 is open. In the absence of such diodes, some voltage from speed adjustment potentiometer 118 would be fed through resistor 134, shunt resistor 136 and shunt resistor 142 to comparator 122, whereby to affect the speed of motor 28. The same effect on motor 28 would occur by some voltage from speed adjustment potentiometer 128 feeding through resistor 140 and shunt resistors 142 and 136 to comparator 112.

FIG. 15 illustrates an arrangement by which the rotational speed of the drive motors 26 and 28 may be varied over a range. Instead of connecting the switch 110 to ground, as in FIG. 14, the switch is connected to the movable contact 146 of a variable resistor 148. The movable contact may be manipulated manually or automatically as explained hereinafter. As illustrated, the resistor 148 is connected at its opposite ends to ground and functions as a potentiometer. Thus, with the movable contact 146 of potentiometer 148 centered as illustrated and switch 110 connected to contact 132, voltage shunting is at a minimum. However, as the movable contact is moved in either direction toward ground, progressively more of the voltage previously supplied to comparator 112 by speed adjustment potentiometer 118 is shunted through the potentiometer to ground through resistor 134, shunt resistor 136, diode 138, switch 110 and potentiometer 148. The speed of motor 26 thus will decrease. The same action will occur for drive motor 28 because of the shunting of some of the voltage previously supplied to comparator 122 through speed adjustment potentiometer 128, resistor 140, shunt resistor 142, diode 144, switch 110 and potentiometer 148.

It is to be noted that when switch 110 is connected to contact 132, any change in rotational speed of the drive motors 26 and 28 is in the direction of decreased speed. This mode is employed when it is desired to reduce the speed of a pitched ball, as for changing from a fast ball to a change-up, and others. When it is desired to increase the speed of a pitched ball, the switch 110 is moved to close contact 150.

When switch 110 is closed on contact 150 and is connected directly to ground as in FIG. 14, some of the voltage previously supplied by tachometer 114 to the negative input of comparator 112 through resistor 152 is shunted to ground through shunt resistor 154, diode 156 and switch 110. This causes the comparator to provide an electrical signal to the powered device 120 to increase the rotational speed of drive motor 26. Drive motor 28 also will increase in speed because of the shunting action through resistor 158, shunt resistor 160 and diode 162.

When switch 110 is closed on contact 150 and is connected to the movable contact 146 of potentiometer 148, as in FIG. 15, the shunting action described hereinbefore with reference to contact 132 will result in no significant change of rotational speed of drive motors 26 and 28 when the movable contact 146 is centered on potentiometer 148. However, progresively increased rotational speed of the drive motors will occur as the movable contact 146 is moved toward either grounded end of potentiometer 148.

It will be apparent that the variable resistor 148 may be utilized as a rheostat simply by leaving one end ungrounded. In such instance the voltage shunting increases progressively from the ungrounded end to the grounded end, as will be understood.

In the foregoing description, all of the speed control potentiometers 118, 128 and 148 and selector switch 110 are manipulated manually by control knobs 118' 128', 148' and switch lever 110', respectively, from the convenient location of a control panel 164. In the embodiment illustrated, the control panel is provided by the front panel of the hollow base member 58.

Figure 11:
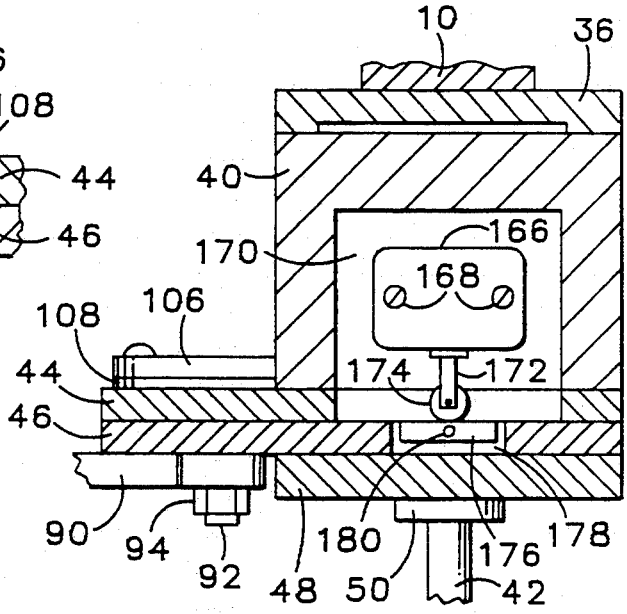
FIG. 11 is a fragmentary sectional view taken on the line 11—11 in FIG. 9.
Figure 12:
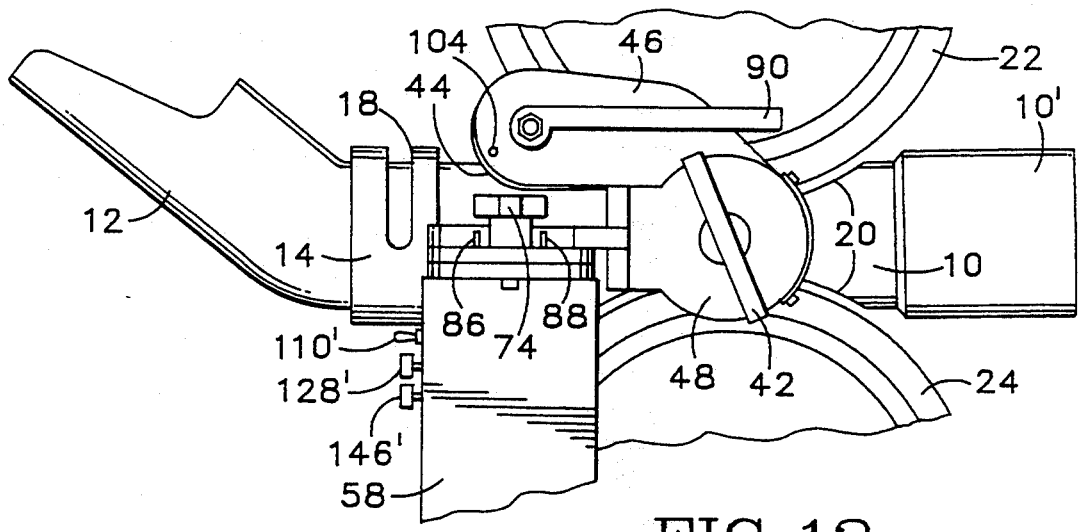
FIGS. 12 and 13 are fragmentary side elevations showing the vertical incremental adjustment at opposite maximum positions.
Figure 13:
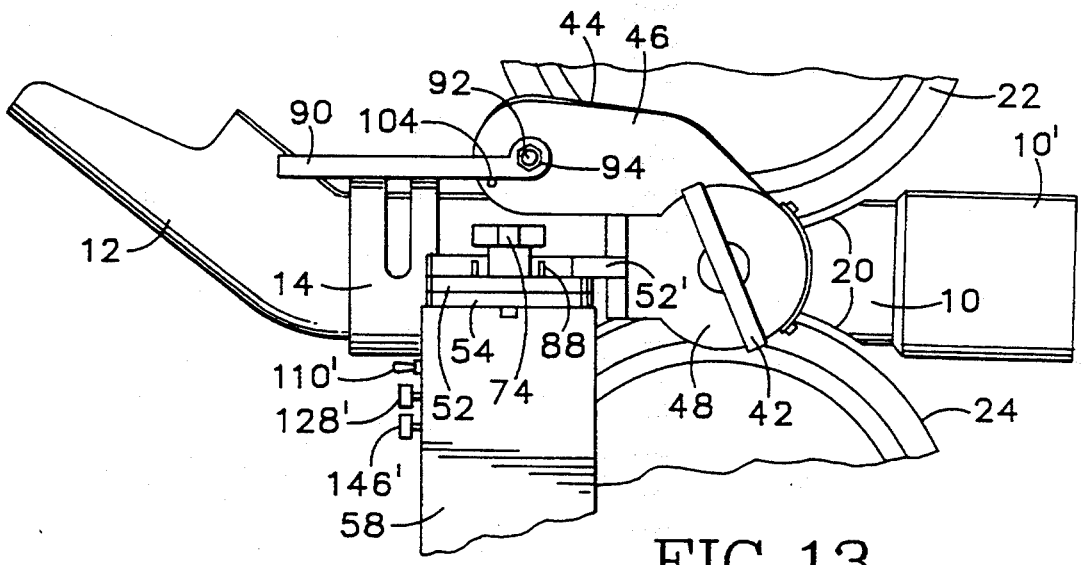

In the preferred embodiment of this invention, the movable contact 146 of variable resistor 148 is controlled automatically by the mechanism that effects changes in elevation of the ball feed shute 10. To this end, the potentiometer 148 is supported in a housing 166 (FIGS. 9 and 11) mounted by screws 168 in a chamber 170 formed in the cylinder 40. The spring-loaded actuator arm 172 of the potentiometer 148 extends outwardly through the housing 166. A roller 174 on the outer end of arm 172 is positioned for rolling engagement with a bar 176 located within a slot 178 in the anchor plate 46. A pivot pin 180 on the anchor plate mounts the bar for pivotal movement within the slot about an axis that extends perpendicular to the rotational axis of the cylinder.

Accordingly, when the cylinder rotates about the axis of clamp screw 42, the roller 174 rolls along the surface of the bar 176. The spring loading of the actuator arm 172 urges the latter outwardly of the housing 166 and causes pivoting of the bar as the roller moves to opposite sides of the central pivot pin 180. The chamber and its contents are protected against weather and other contamination by cover 182 secured to cylinder 40 by screws 184.

When the actuator arm 172 is operatively connected to the movable contact 146 of variable resistor 148, the configuration provides for the contact 146 to be at the center of the resistor 148 when roller 174 is centered on the bar 176 directed over pivot pin 180. As the cylinder 40 is rotated in either direction by lever 90 to effect a change in elevation of the ball feed tube 10, the roller 174 moves toward one end or the other of the bar 176. The spring loading of the actuator arm 172 urges the latter outwardly of the housing 166 as the bar 176 is pivoted. This outward movement of arm 172 moves the contact 146 toward the grounded end of the resistor 148. As explained hereinbefore, this results in some of the voltage previously supplied to comparators 112 and 122 being shunted to ground. Depending upon whether selector switch 110 is connected to contact 132 or contact 150, the rotational speed of drive motors 26 and 28 will be decreased or increased, respectively.

The operation of the ball pitching device described hereinbefore is as follows: With the device positioned at a pitcher's mound, the operator loosens nut 60 and rotates the assembly mounted on the body member 58 to aim the ball feed tube 10 to the desired position of delivery of a ball relative to the horizontal dimensions of a home plate and the position of a practicing batter. The nut 60 then is tightened. Adjustment to a desired height of pitch above ground level then is achieved by loosening clamp screw 42 to relieve the clamping pressure of the plates 38 and 44 against the opposite ends of cylinder 40. This enables the operator to rotate the ball feed tube 10 about the horizontal axis of clamp screw 42 to achieve the desired elevation of the tube 10 that will deliver a pitched ball at the desired height above ground at the speed set by the speed adjustment potentiometers 118 and 128.

When it is desired to change the horizontal direction of delivery of a pitched ball relative to the side margins of a home plate, i.e. to deliver a pitch more inside or more outside relative to a practicing batter located at the home plate, the operator rotates the horizontal adjustment knob 74 to any selected degree between the limits of stop pins 86 and 88. Rotation of knob 74 is accompanied by rotation of shaft 76 and cam pin 80. As the cam pin is rotated eccentrically about the axis of shaft 76, its confinement in slot 82 in anchor plate 54 results in a leveraged pivotal movement of pivot plate 52 about the vertical axis of pivot bolt 56. This pivotal movement of plate 52 causes the ball feed tube to be pivoted horizontally to change the horizontal delivery of a pitched ball. The full range of incremental movement of the feed tube 10 does not need to exceed about 2°.

When it is desired to change the elevation by an incremental degree, the operator rotates the lever 90 through a selected arc about the axis of its support shaft 96. This rotation of lever 90 is accompanied by rotation of shaft 96 and cam pin 100. As the cam pin rotates with shaft 96, its confinement in slot 102 causes the pivot plate 44 to rotate about the horizontal axis of clamp screw 42. The cylinder 40 thereby is rotated and the ball feed tube is rotated with it.

When selector switch 110 is connected to ground, as in the manner illustrated in FIG. 14, the lever 90 must be rotated sufficiently to move the switch 110 into engagement with contact 132 if the pitch speed is to be decreased, or with contact 150 if the pitch speed is to be increased. 0n the other hand, when the selector switch 110 is connected to the movable contact 146 of variable resistor 148, the lever 90 may be rotated through lesser arcs to provide an infinite number of pitch speeds within the range established by the range of movement of the contact 146 over the resistor 148. The maximum rotation of lever 90 need provide no more than about 4° range of elevation adjustment.

From the foregoing it will be appreciated that this invention provides for the incremental changing of pitched balls horizontally and vertically relative to a practicing batter standing at a home plate. These changes may be made without the knowledge of the batter and simultaneously with changes in speed of pitches. The practicing batter thus is afforded important training in learning immediate recognition of changes in the speed and position of pitches, as experienced in actual play.

It will be apparent to those skilled in the art that various changes may be made in the size, shape, type, number arrangement of parts and electrical circuitry described hereinbefore without departing from the spirit of this invention and the scope of the appended claims.

We claim:

1. A ball pitching device, comprising:

a) a base, b) ball feed means having a longitudinal ball-projecting axis, c) ball projecting means associated with the ball feed means for projecting a ball along said longitudinal axis, the ball projecting means including a rotary ball projecting wheel, an electric motor engaging the wheel for rotating the latter, and an electric circuit connected to the electric motor for varying the rotational speed of the motor and wheel, d) vertical adjustment means having a horizontal pivot axis, e) means mounting said vertical adjustment means on said base, f) means mounting said ball feed means and ball projecting means on said vertical adjustment means, g) the vertical adjustment means being operable to move the longitudinal ball projecting axis about said horizontal pivot axis, and h) incremental adjustment means engaging the vertical adjustment means for pivoting the latter incrementally about said horizontal pivot axis for changing the elevation of the longitudinal ball projecting axis vertically in incremental amounts the electric circuit including adjustable electric motor speed control means operable to adjust the electric motor speed in accordance with the incremental adjustment of the vertical adjustment means.

2. The ball pitching device of claim 1 wherein the vertical adjustment means includes an anchor plate and a pivot plate, the anchor plate being mounted on the base and the pivot plate mounting the ball feed means and ball projecting means.

3. The ball pitching device of claim 2 wherein the incremental adjustment means includes lever means interengaging the anchor plate and pivot plate at a position spaced from said horizontal pivot axis.

4. The ball pitching device of claim 1 wherein the adjustable electric motor speed control means includes an electric switch and associated electric circuitry for effecting change in rotational speed of the electric motor.

5. The ball pitching device of claim 4 including coupling means interengaging the electric switch and the incremental adjustment means of the vertical adjustment means for effecting change in electric motor speed simultaneously with incremental change in elevation.

6. The ball pitching device of claim 1 wherein the adjustable electric motor speed control means includes variable resistance means and associated electric circuitry for effecting change in rotational speed of the electric motor.

7. The ball pitching device of claim 6 including coupling means interengaging the variable resistance means and the incremental adjustment means of the vertical adjustment means for effecting change in electric motor speed simultaneously and in correspondence with incremental change in elevation.

8. A ball pitching device, comprising:

a) a base, b) ball feed means having a longitudinal ball projecting axis, c) ball projecting means associated with the ball feed means for projecting a ball along said longitudinal axis, d) horizontal adjustment means having a vertical pivot axis, e) vertical adjustment means having a horizontal pivot axis, f) means interconnecting said horizontal adjustment means and vertical adjustment means, g) means mounting one of said horizontal adjustment means and vertical adjustment means on said base, h) means mounting said ball feed means and ball projecting means on the other of said horizontal adjustment means and vertical adjustment means, i) the horizontal adjustment means being operable to move the longitudinal ball projecting axis about said vertical pivot axis, j) the vertical adjustment means being operable to move the longitudinal ball projecting axis about said horizontal pivot axis, k) incremental adjustment means engaging the horizontal adjustment means for pivoting the latter incrementally about said vertical pivot axis for changing the longitudinal ball projecting axis horizontally in incremental amounts, and l) incremental adjustment means engaging the vertical adjustment means for pivoting the latter incrementally about said horizontal pivot axis for changing the elevation of the longitudinal ball projecting axis vertically in incremental amounts.

9. The ball pitching device of claim 8 wherein the horizontal adjustment means includes an anchor plate and a pivot plate, and the vertical adjustment means includes an anchor plate and a pivot plate, the anchor plate of one of said horizontal adjustment means and vertical adjustment means being connected to the pivot plate of the other of said horizontal adjustment means and vertical adjustment means.

10. The ball pitching device of claim 9 wherein the anchor plate of the horizontal adjustment means is mounted on the base and the pivot plate of the vertical adjustment means mounts the ball feed means and ball projecting means.

11. The ball pitching device of claim 9 wherein the incremental adjustment means of the horizontal adjustment means includes lever means interengaging the anchor plate and pivot plate at a position spaced from said vertical pivot axis, and the incremental adjustment means of the vertical adjustment means includes lever means interengaging the anchor plate and pivot plate at a position spaced from said horizontal pivot axis.

12. The ball pitching device of claim 8 wherein:

a) the horizontal adjustment means includes an anchor plate and a pivot plate, b) the vertical adjustment means includes an anchor plate and a pivot plate, c) the anchor plate of one of said horizontal adjustment means and vertical adjustment means being connected to the pivot plate of the other of said horizontal adjustment means and vertical adjustment means, d) the anchor plate of the horizontal adjustment means is mounted on the base and the pivot plate of the vertical adjustment means mounts the ball feed means and ball projecting means, e) the incremental adjustment means of the horizontal adjustment means includes lever means interengaging the anchor plate and pivot plate at a position spaced from said vertical pivot axis, f) the incremental adjustment means of the vertical adjustment means includes lever means interengaging the anchor plate and pivot plate at a position spaced from said horizontal pivot axis, and g) the ball projecting means includes a rotary ball projecting wheel, an electric motor engaging the wheel for rotating the latter, an electric circuit connected to the electric motor for varying the rotational speed of the motor and wheel, and the electric circuit includes adjustable electric motor speed control means operable to adjust the electric motor speed in accordance with the incremental adjustment of the vertical adjustment means.

13. The ball pitching device of claim 12 wherein the adjustable electric motor speed control means includes an electric switch and associated electric circuitry for effecting change in rotational speed of the electric motor.

14. The ball pitching device of claim 13 including coupling means interengaging the electric switch and the lever means of the incremental adjustment means of the vertical adjustment means for effecting change in electric motor speed simultaneously with incremental change in elevation.

15. The ball pitching device of claim 12 wherein the adjustable electric motor speed control means includes variable resistance means and associated electric circuitry for effecting change in rotational speed of the electric motor.

16. The ball pitching device of claim 15 including coupling means interengaging the variable resistance means and the lever means of the incremental adjustment means of the vertical adjustment means for effecting change in electric motor speed simultaneously and in correspondence with incremental change in elevation.

* * * * *